United States Patent [19]

Harrison

[11] 4,190,113

[45] Feb. 26, 1980

[54] WELL CLEANOUT TOOL

[76] Inventor: Wayne O. Harrison, 218 W. 465th St., Odessa, Tex. 79762

[21] Appl. No.: 928,532

[22] Filed: Jul. 27, 1978

[51] Int. Cl.[2] ..... E21B 37/00

[52] U.S. Cl. ..... 166/311; 166/107

[58] Field of Search ..... 166/311, 107, 162, 167, 166/169, 99, 108–111

[56] References Cited

U.S. PATENT DOCUMENTS

| | | | |
|---|---|---|---|
| 563,055 | 6/1896 | Palm | 166/107 |
| 1,537,201 | 5/1925 | Swan | 166/107 |
| 2,000,750 | 5/1935 | Gates | 166/167 X |
| 2,180,935 | 11/1939 | Dumble | 166/107 |
| 2,182,374 | 12/1939 | Dumble | 166/107 X |

*Primary Examiner*—William F. Pate, III

*Attorney, Agent, or Firm*—Marcus L. Bates

[57] ABSTRACT

A well cleanout tool which requires no hydrostatic head, and which can be either wireline or tubing conveyed and actuated. The tool comprises an elongated main body having a pump means flow connected to a debris-retaining chamber contained therein. The pump means is actuated by reciprocating the wireline or the tubing, as the case may be, thereby causing fluid to move through the tool, whereupon debris settles out in the debris-containing chamber, while substantial debris-free fluid flows through the pump, through an outlet formed in the upper end of the tool, and back into the borehole. The pump preferably is of the reciprocating type, having a splined driveshaft, which enables the tool to be rotated while it is being reciprocated, when it is tubing conveyed. Accordingly, it is unnecessary to undergo the expense of charging the borehole with a large hydrostatic head of fluid. The tool can be actuated until all of the debris has filled the debris-retaining chamber, thereby avoiding a plurality of trips into the borehole.

8 Claims, 8 Drawing Figures

WELL CLEANOUT TOOL

BACKGROUND OF THE INVENTION

Well cleanout tools find their maximum utility when employed for removing frac sand from the bottom of the borehole. From time to time, it is necessary to acidize a formation by pumping acid downhole through the perforations in the casing and back up into the hydrocarbon producing formation. Propping agents, such as specially selected sand, are pumped downhole either during or after the acidizing operation. After the fracturing operation has been completed, the borehole will often contain 100 feet or more of sand which lies in proximity of the perforated zone, and accordingly, the sand must be removed before the well is placed back onto production.

Well cleanout tools utilizing hydrostatic pressure for inducing flow may be actuated by a sand line, or the tool may be tubing conveyed. The debris capacity of the tool depends upon the size of the debris-containing reservoir coupled with the magnitude of the hydrostatic head, both of which must be considerably large if a significant quantity of debris is to be recovered.

It is expensive to charge a borehole with several truckloads of brine in order to achieve the hydrostatic head required of prior art hydrostatic bailers. It is expensive to build and operate a tool having a tremendous debris-containing reservoir. It is also expensive, especially when the tool is tubing conveyed, to make a plurality of trips into the borehole in order to retrieve all of the junk located downhole therein.

Running a tool of the above type is dangerous because the recovered tool must inherently have an internal pressure of more than 1000 psi sometimes. It is, therefore, possible to cause fatal or serious injuries when the tool is subsequently disassembled.

Occasionally, the tailpipe of a well cleanout tool becomes submerged into the debris to such an extent that the tool becomes lodged in the borehole. Such a disastrous situation calls for a workover rig, pumps, and an overshot in order to wash the debris from the tool, thereby freeing the tool after spending a substantial amount of money on a "fishing job".

Accordingly, it would be desirable to obviate the above mentioned drawbacks by the provision of an improved wellbore cleanout tool. Such a desirable expedient is the subject of the present invention.

SUMMARY OF THE INVENTION

This invention encompasses both method and apparatus for cleaning debris from the bottom of a borehole. The method of the invention comprehends running a pump means downhole into the borehole until the pump means is located within pumping distance of the fluid column. A fluid conduit is extended from the pump means into contact with the debris to be removed. The conduit is connected to the pump and a debris-containing chamber is connected in series relationship with the pump and fluid conduit. The pump is actuated from the surface of the earth to cause the fluid and debris to flow through the fluid conduit and into the chamber, where most of the debris remains within the chamber while the fluid flows on through the pump, through an outlet provided in the tool, and back into the borehole.

The apparatus is progressively lowered into the column of debris while the pumping action is continued so that all of the debris can be transferred from the borehole into the chamber, while fluid is continually returned to the borehole for reuse as many times as may be necessary.

The pump is subsequently retrieved along with the debris contained within the chamber, and the well placed on production.

An outstanding feature of the present invention is the efficient operation achieved when the apparatus is used in boreholes having a low fluid head.

The apparatus by which the above method is carried out comprises a tool in the form of an elongated, cylindrical body having a lower inlet end into which fluid and debris may flow. An upper outlet end is spaced from the inlet end. The tool is arranged internally such that fluid can flow from the inlet, axially through the tool, out of the outlet, and back into the borehole.

Support means, in the form of a wireline or a tubing string, is connected at the upper end of the body to enable manipulation of the tool. A medial body portion of the tool is in the form of an elongated, hollow member for containing well fluid and debris. A pump means is located within the main body at a location between the inlet and the outlet, and preferably between the upper outlet end and said medial body portion. The pump forces fluid to flow from the inlet, through the debris-containing chamber, and through the upper outlet end.

A trap means located between the inlet and the medial body portion enables fluid and debris to flow in only one direction into the chamber where the debris remains while the pump forces fluid to flow on through the tool. The support means is connected to the pump so that the pump can be actuated in response to the support means being reciprocated respective to the housing.

The tool includes an anchor means by which it is releasably affixed to the sidewall of the borehole so that the elevation of the tool can be controlled respective to the elevations of the debris contained within the well, thereby avoiding inadvertently sucking the lower marginal end of the tool too far down into the debris column.

Accordingly, a primary object of the present invention is the provision of a method by which debris can be efficiently removed from the bottom of a borehole.

Another object of the invention is to provide a method by which debris can be removed from a borehole wherein the borehole has a very low hydrostatic fluid head above the debris.

A further object of this invention is to disclose and provide a method for removing debris from a borehole wherein fluid and debris enter a chamber, the debris remains within the chamber, and the fluid is returned to the borehole for reuse.

A still further object of this invention is the provision of a method for cleaning debris from boreholes wherein a cleanout tool is anchored to the borehole wall, fluid is forced through the tool by a surface-actuated pump means, the fluid entrains debris contained within the borehole so that both fluid and debris flow into a chamber, the debris is retained within the chamber, and the fluid is returned to the borehole.

Another and still further object of this invention is to provide apparatus by which debris can be removed from the lower marginal end of a borehole.

An additional object of this invention is to disclose and provide an improved well cleanout tool by which debris can be removed from a borehole having a very low hydrostatic head.

Another object of the invention is the provision of a well cleanout tool which includes a pump means actuated from the surface of the earth so that debris-entrained fluid is forced to flow into a chamber wherein the debris is retained therewithin while the fluid is returned to the borehole.

A further object of this invention is to provide a well cleanout tool having a pump means and an anchor means associated therewith so that the tool can be anchored to the borehole wall, the pump manipulated from the surface, thereby causing fluid and debris to be forced to flow into the tool, where the debris is retained and the fluid is returned to the borehole.

A still further object of this invention is to disclose and provide improvements in well cleanout tools which enable debris to be removed from the borehole wherein the borehole has a very low hydrostatic head.

These and various other objects and advantages of the invention will become readily apparent to those skilled in the art upon reading the following detailed description and claims and by referring to the accompanying drawings.

The above objects are attained in accordance with the present invention by the provision of an apparatus fabricated in a manner substantially as described in the above abstract and summary.

DETAILED DESCRIPTION OF THE PREFERRED EMBODIMENT

Throughout the remainder of this specification, like or similar numerals generally refer to like or similar parts.

Figure 1:
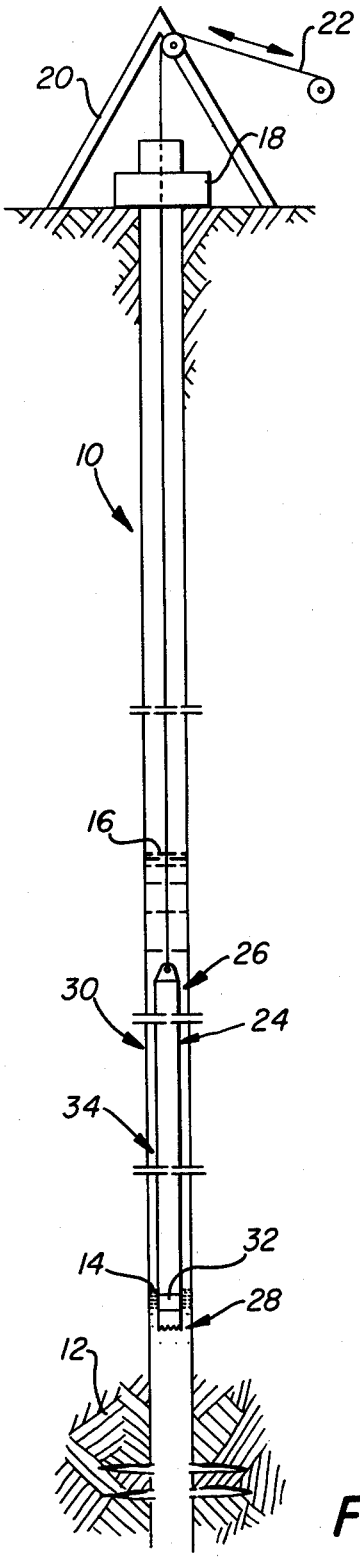
FIG. 1 is a part diagrammatical, part schematical representation of a borehole having a well cleanout tool included therewithin, made in accordance with the present invention.

In FIG. 1, there is disclosed apparatus by which the method of the present invention can be carried out. As seen in FIG. 1, a borehole 10 extends down into the bosom of the earth and to a hydrocarbon producing formation 12. Debris overlies the production formation, with the debris extending up to the elevation indicated by the numeral 14. Fluid, such as water, overlies the debris and extends uphole to the elevation indicated by the numeral 16. Wellhead 18 is connected to the uppermost end of the borehole. A workover rig 20 is positioned on location and includes means by which a wireline or sand line 22 can be wound onto a winch, thereby enabling the wireline to be reciprocated or withdrawn from the borehole.

A well cleanout tool 24, made in accordance with the present invention, is located such that the upper end 26 thereof is in close proximity to the fluid level, while the lower end 28 thereof is in contact with the debris.

The tool includes a pump section 30, a lower flapper valve sub 32, and a debris-containing chamber 34. The chamber 34 is sometimes 1000 feet in length, depending upon the volume of debris to be removed from the borehole.

Figure 2:
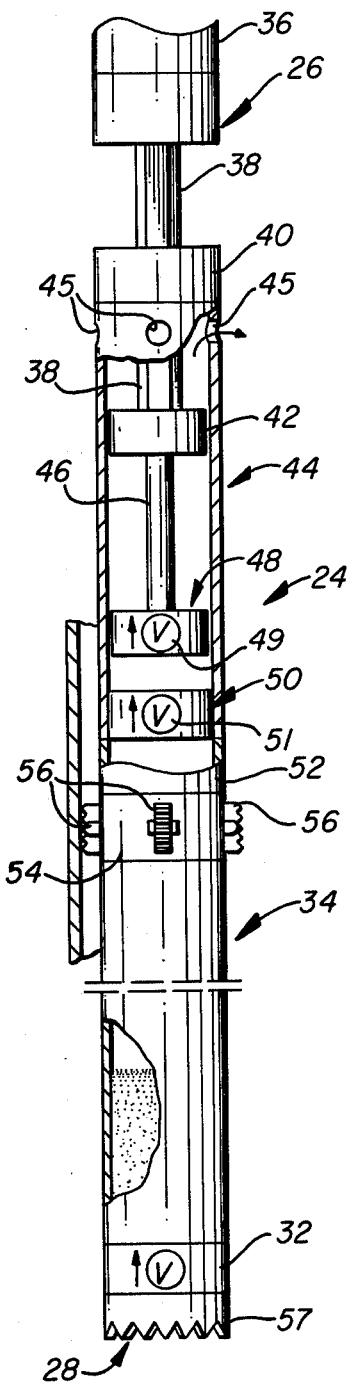
FIG. 2 is an enlarged, fragmentary, part cross-sectional representation of the tool disclosed in FIG. 1.

As seen in FIG. 2, in conjunction with other figures of the drawings, tubing 36 can be connected to the upper end or sub 26 of the tool in lieu of the before mentioned wireline. The tubing enables the tool to be run downhole and simultaneously reciprocated while being axially rotated.

Upper end, or sub 26, is rigidly affixed in a removable manner to a spline shaft 38 which is slidably received by a sub 40, with the last named sub having a complementary female spline formed axially therein so that when tubing 36 rotates sub 26, spline 38 rotates therewith and imparts rotational motion into the sub 40 and hence into the lower remaining part of the tool.

Enlargement 42 is connected to the lower end of the spline and reciprocates within pump barrel 44. Piston rod 46 interconnects piston 48 to the enlargement 42 and hence to the spline of the sub and to the tubing.

Pump piston 48 contains a one-way traveling valve 49 therein which admits flow into chamber 44, through outlet 45, and back into the wellbore, as will be better appreciated later on as this disclosure is more fully disgested.

Standing valve sub 50 has a one-way valve 51 therein and is affixed to the main pump body and permits flow in the indicated direction. Sub 52 connects the pump section 30 to the debris-containing chamber 34.

Anchor sub 54 includes a plurality of radially spaced-apart retractable anchors 56 which are controllably extended or retracted by manipulation of tubing 36. The lowermost end portion of the tool string preferably is serrated in the manner indicated by numeral 57.

Figure 3:
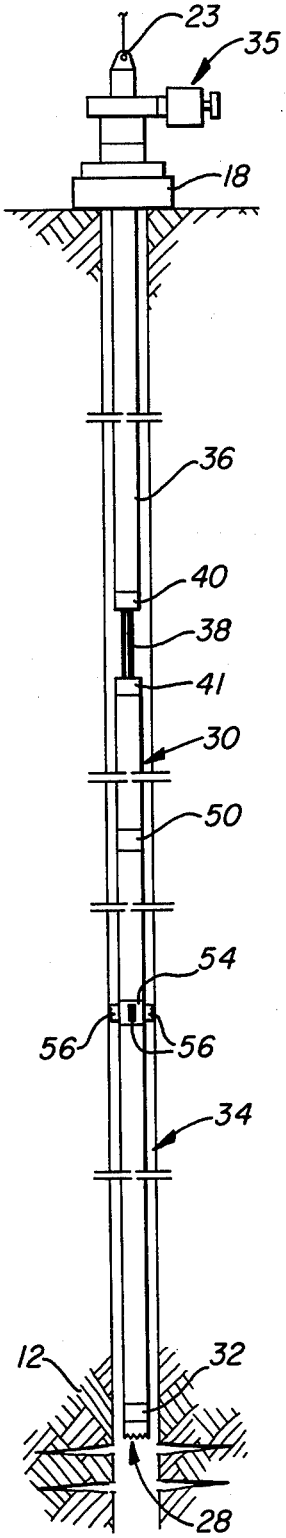
FIG. 3 sets forth a modification of the apparatus disclosed in FIGS. 1 and 2.

In FIG. 3, the tool of FIG. 2 is seen to be connected to tubing string 36, which extends uphole, perhaps several thousand feet, through the wellhead, and to a turntable 35 of a workover or drilling rig which enables the tubing string to be rotated. Simultaneously with the rotational motion provided by the workover rig, the tubing string can be lifted or lowered into the wellbore by the sandline attached to the kelly at 23.

Figure 4:
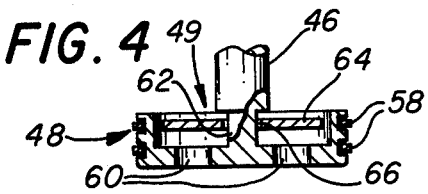
FIG. 4 is an enlarged, fragmentary, part cross-sectional detailed view of part of the apparatus disclosed in the foregoing figures.

The traveling valve 48 can take on several different forms so long as a valve admits flow of fluid to occur from the debris-containing chamber and on through the outlet 45. As seen in FIG. 4, the combination piston and traveling valve includes piston rings 58 which sealingly engage the space between the reciprocating piston and the interior wall of the barrel. Radial ports 60 are formed through the piston. Shaft 46 is reduced in diameter at 62 and has the end thereof rigidly affixed to the piston. Valve element 64 is apertured at 66 so that it is slidably received by the reduced shaft portion and gravitates against the apertured piston.

Figure 5:
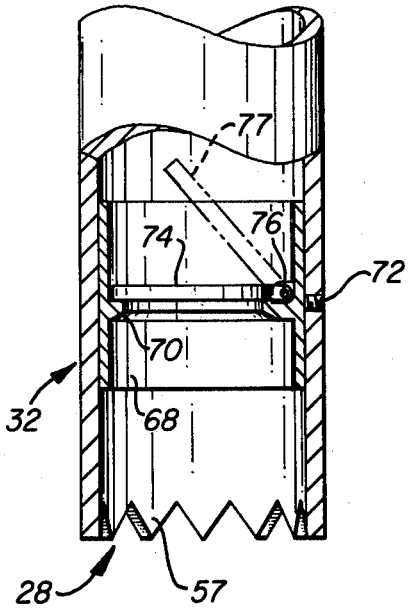
FIG. 5 is a fragmentary, part cross-sectional, side elevational, detailed view of part of the apparatus disclosed in the foregoing figures.

In FIG. 5, the flapper valve assembly, which can take on several different forms, is illustrated as being contained within a removable skirt member 68 having an inwardly directed seat 70. The skirt is held in position by a set screw 72. Valve element 74 is pivotally attached to the skirt by pivot means 76 so that the element can be moved from the illustrated closed position into the illustrated dot-dash open position indicated by numeral 77.

Figure 8:
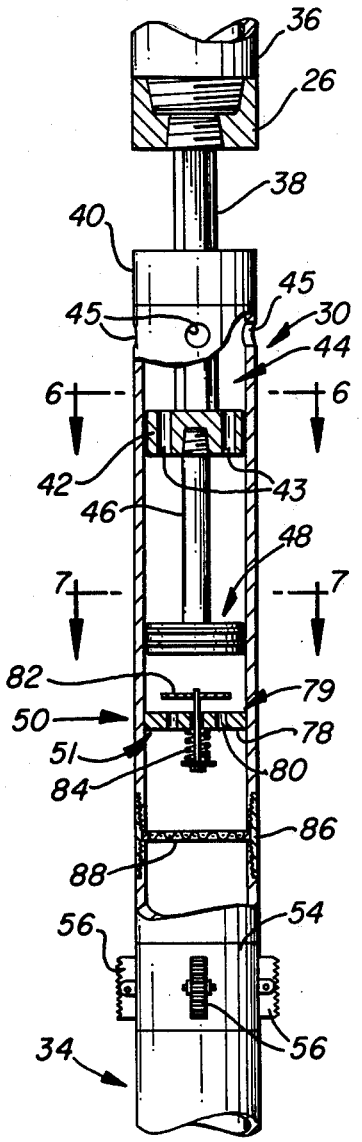
Figure 6:
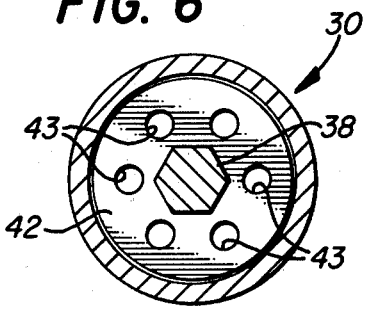
FIGS. 6 and 7, respectively, are cross-sectional views taken along lines 6—6 and 7—7, respectively, of FIG. 8; and, FIG. 8 is a fragmentary, longitudinal, part cross-sectional, side elevational view which sets forth the details of part of the apparatus disclosed in FIG. 2.
Figure 7:
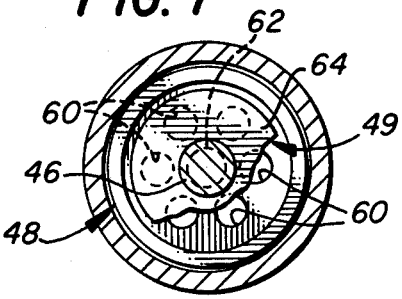

In FIG. 8, the standing valve 50 is seen to include a valve seat 79 in the form of a circular plate member 78 having radially spaced-apart apertures 80 formed therethrough. Valve element 82 is spring loaded at 84 so that it normally remains biased into the closed position except on the illustrated suction stroke of the piston 48.

In order to prevent sand cutting the standing valve and traveling valve, screen sub 86 can be interposed between the standing valve of the pump assembly and the debris-containing chamber. The screen sub includes screen 88 which precludes particles larger than a predetermined size from entering the pump section of the apparatus.

The method of the invention can be practiced by employment of the well cleanout tool illustrated in the foregoing figures. As seen illustrated in FIGS. 1–3, the method of the present invention comprehends the cleaning of debris from a lower marginal end portion of a borehole wherein the borehole has a fluid column above the debris of a sufficient quantity to be within pumping distance of a pump means.

The term "pumping distance" relates to a fluid column having an effective fluid head within 29 feet of the pump piston or the equivalent thereof.

The method is carried out by running a pump means downhole into the borehole until the pump means is located within pumping distance of the fluid column. A flow conduit is extended from the pump to the debris to be removed. A debris-containing chamber is series connected respective to the pump and the fluid conduit so that as the pump transfers debris-laden fluid from the borehole into the chamber, most of the debris remains within the chamber, while the fluid is returned by the pump to the borehole. The fluid rate of flow is controlled to cause this unusual event to happen. The fluid conduit is progressively lowered as the debris is transferred into the chamber, while continuing the pumping action until all of the debris has been transferred from the borehole into the chamber, whereupon the pump, along with the chamber, debris, and the fluid conduit are removed from the borehole.

Anchoring means 56 enables the fluid conduit to be positioned at a predetermined location respective to the debris, thereby obviating the pumping action from sucking the conduit down into the debris, whereupon the debris causes the apparatus to be stuck downhole in the borehole. Suitable anchoring devices and the operation thereof are illustrated in "Baker 1970–1971 oil tool catalog page 537, 6023 Navigation Blvd., Houston, Tex. 77001".

In operation, the workover rig is positioned over the borehole. The tool is run downhole by making up joints of tubing into a string in the usual manner. The height of the column of sand, the fluid depth, as well as the location of the perforations should be known.

Assuming 100 feet of frac sand in a 5½ inch casing with 800 feet of fluid, and a string of 2 inch tubing racked on the job, it would be necessary to run 600 feet of debris chamber under the pump in order to recover all of the sand. Hence, the pump of the tool will be under a positive hydrostatic head of about 200 feet or less.

The pipe tally as well as the weight indicator on the workover rig tells when the tool is in proximity of the sand. The tool string is run downhole at a very slow rate when the tally indicates that the tool is about to contact the top of the sand.

It will be noted that as the tool is run downhole, air is displaced from the interior of the tool because of the inherent action of the valves 32, 51 and 49 which admit flow only in an upward direction. Hence, the tool will have no tendency to float, although the tubing 36 located thereabove will remain filled with air and therefore will offset the weight of the toolstring.

When the weight indicator signifies that the lower end 28 has contacted the debris, the toolstring is picked up until the weight indicator returns to its original value, whereupon the tubing is marked with an indicator means, such as a chalk mark. The indicator means is used to approximate the length of the strokes imparted into the tubing string and hence into the pump. From time to time the indicator means must be moved up the pipe, and from time to time, additional joints of pipe must be added to the toolstring.

The toolstring is reciprocated by the workover rig, and simultaneously, rotational motion is imparted thereinto. Reciprocation preferably occurs at 10 to 20 strokes per minute while rotating. This action continues until measurements indicate that the entire sand column has been transferred into the tool, or alternatively, the weight indicator signifies that the lower end 28 of the tool is sitting on bottom. It is now time to come out of the hole.

Where deemed desirable, sub 57 can be a fishing tool in order to perform various different operations, as for example, retrieving a bridge plug from a packer, where a dual formation is involved, or for that matter, retrieving the packer itself.

A safety joint can be interposed between subs 32 and 57, where deemed desirable, so that should the tool become stuck, the safety joint can be released from the remainder of the tool string and everything above the safety joint removed from the borehole. The safety joint is subsequently removed by an overshot.

I claim:

1. A well cleanout tool, comprising; an elongated main body having a lower inlet end into which fluid and debris may flow, and an upper outlet end having means by which fluid may be returned to the wellbore; said inlet end being spaced from said outlet end;

support means connected at said upper outlet end of the main body by which said tool can be supported, the medial body portion of the tool being an elongated, hollow member for containing well fluid and debris;

a pump means located within said main body at a location between said upper outlet end and said lower inlet end for forcing fluid to flow from said lower inlet end, through said medial body portion, and through said upper outlet end;

said pump means includes a pump barrel axially formed within said main body, and a piston reciprocatingly received within said barrel, a piston rod by which said piston is connected to be reciprocated by said support means;

a traveling valve in said piston, a standing valve located between said inlet end and said pump barrel;

a closure member at said upper outlet end; means by which said piston rod extends through said closure member; an abutment means formed on said piston rod at a location between said piston and said closure member so that the abutment means engages the closure member when the piston is reciprocated uphole by said support means to thereby provide a jarring effect;

a trap means located between said lower inlet end and said medial body portion through which fluid and debris may flow while said pump forces fluid to flow through said tool.

2. The tool of claim 1 wherein means are provided by which said cleanout tool is run downhole on the end of a tubing string so that the tubing string can be used to manipulate the tool.

3. The tool of claim 2 wherein said main body includes an anchor means which can be extended outwardly therefrom by which the tool can be anchored downhole in a borehole while the pump is actuated by the tubing string.

4. The tool of claim 1 wherein means are provided by which a wireline is attached to said support means and the tool is run downhole on the wireline.

5. The tool of claim 1 wherein said piston rod and said closure member are splined, said piston rod extends through the splined closure member so that the abutment means engages the closure member when the pump is reciprocated uphole by said support means to thereby provide a jarring effect, and the spline of the rod and closure member enables rotation of the support means to impart rotational motion into the main body;

and wherein means are provided by which said cleanout tool is run downhold on the end of a tubing string so that the tubing string can be used to manipulate the tool.

6. The tool of claim 1 wherein said pump means is located between said upper outlet end and said medial body portion, with there being outlet ports formed between said barrel and said closure member.

7. Method of cleaning debris from a lower marginal end portion of a borehole having a fluid column above the debris, comprising the steps of:

(1) running a reciprocating pump means downhole into the borehole on the end of a tubing string until the pump means is located within pumping distance of the fluid column;

(2) extending a fluid conduit within the fluid column and into contact with the debris, and flow connecting the conduit to the inlet end of the pump;

(3) placing a debris-containing chamber in series with respect to fluid flow through the pump means and the fluid conduit;

(4) connecting the lower end of the tubing string to the piston rod of the reciprocating pump, and actuating the pump means by reciprocating the tubing string to cause the fluid and debris to flow through the fluid conduit and into the chamber;

(5) forming a stop means on the piston rod and abuttingly engaging the upper end of the pump with the stop means to provide a jarring action;

(6) controlling the flow rate through the pump to cause most of the debris of step (4) to remain in the chamber while fluid from the pump outlet is returned to the borehole;

(7) lowering the fluid conduit into the debris while continuing the pumping action until the debris has been transferred from the borehole into the chamber;

(8) retrieving the pump, chamber, and fluid conduit from the borehole by removing the tubing string from the borehole.

8. The method of claim 7 and further including the steps of:

(9) releasably attaching the pump, chamber, and conduit to the borehole wall during the pumping step;

(10) releasing the assembly from the wall and lowering the assembly further into the borehole; and, then again releasably attaching the assembly to the borehole wall during another pumping step; and, continuing the step of progressively lowering the assembly by increments until the well is substantially free of debris.

* * * * *